United States Patent [19]

Oishi

[11] 4,349,139

[45] Sep. 14, 1982

[54] HANG STRAP FOR PORTABLE INSTRUMENT

[76] Inventor: Akira Oishi, 16-18 Isoyama 2-Chome, Suzuka-Shi, Mie-Ken, Japan

[21] Appl. No.: 247,255

[22] Filed: Mar. 25, 1981

[30] Foreign Application Priority Data

Aug. 7, 1980 [JP] Japan ..... 55/112158[U]

[51] Int. Cl.[3] ..... A45F 5/00

[52] U.S. Cl. ..... 224/257; 224/258; 224/908; 224/909

[58] Field of Search ..... 224/260, 250, 257, 258, 224/908, 909

[56] References Cited

U.S. PATENT DOCUMENTS

| | | | |
|---|---|---|---|
| 2,273,136 | 2/1942 | Orech et al. | 224/258 |
| 3,152,738 | 10/1964 | Worsfold, Jr. | 224/908 X |
| 3,326,430 | 6/1967 | Banks | 224/908 X |
| 3,326,432 | 6/1967 | Banks et al. | 224/909 X |
| 3,884,403 | 5/1975 | Brewer | 224/257 X |
| 4,168,022 | 9/1979 | Brewer | 224/257 |

FOREIGN PATENT DOCUMENTS

| | | | |
|---|---|---|---|
| 245405 | 8/1911 | Fed. Rep. of Germany | 224/909 X |

*Primary Examiner*—Steven M. Pollard
*Attorney, Agent, or Firm*—Richard G. Heywood

[57] ABSTRACT

A hang strap for portable instrument is provided. The strap comprises: a neck hang band; a first and second hang rings; a first and second stopping means; and a string; said first and second stopping means being connected to a portable instrument; one end of said string being fixed to said first stopping means and the other end of said string being movably passed through said first hang ring, a string-passing hole of said first stopping means, a string-passing hole of said second stopping means, and said second hang ring, and afterthat being fixed to said second stopping means; in use, said neck hang band being hanged on a user's neck; and a torso portion of said string, which extends between said string-passing hole of said first stopping means and said string-passing hole of said second stopping means, being encircled around the user's torso.

6 Claims, 5 Drawing Figures

HANG STRAP FOR PORTABLE INSTRUMENT

BACKGROUND OF THE INVENTION

The present invention relates to a hang strap for portable instrument such as a camera, binoculars, a portable radio and the like, which strap is used when such portable instrument is carried with the user thereof.

Heretofore, when the user moves or bends, a portable instrument hanged or suspended from the user's neck through a conventional neck strap is often damaged by clashing against something as a result of the free swinging motion of the portable instrument. Therefore, there exists a longfelt need for an improved hang strap for preventing a portable instrument for clashing against something even if the user moves or bends.

SUMMARY OF THE INVENTION

The present invention provides a novel hang strap for portable instrument. The hang strap for portable instrument of the present invention comprises: a neck hang band with first and second hang rings; a first and second stopping means connected to the portable instrument; and a cord or string; one end of said string being fixed to said first stopping means and the other end of said string being movably passed through said first hang ring and back through a string-passing hole of said first stopping means, the other end of the string passes through a string-passing hole of said second stopping means, and said second hang ring, and after that is fixed to said second stopping means; in use said neck hang band is hanged on a user's neck; and a torso portion of said string, which extends between said string-passing hole of said first stopping means and said string-passing hole of said second stopping means, being circled around the user's torso.

Objects, features, and advantages of the present invention will become apparent in the course of the description.

BRIEF DESCRIPTION OF THE DRAWINGS

The full nature of the present invention will be understood from the accompanying drawings and the following description and claims, in which:

DETAILED DESCRIPTION OF THE INVENTION

Figure 1:
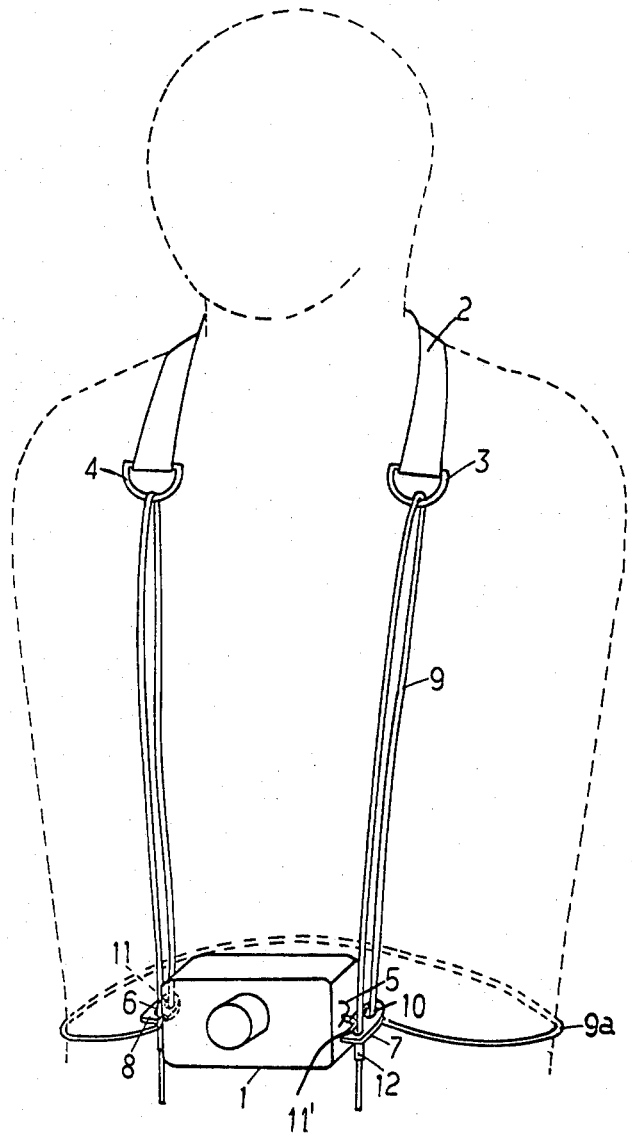
FIG. 1 is a frontal view showing one of the embodiments of the present invention and in which the portable instrument is shown as a camera carried by the user.
Figure 2:
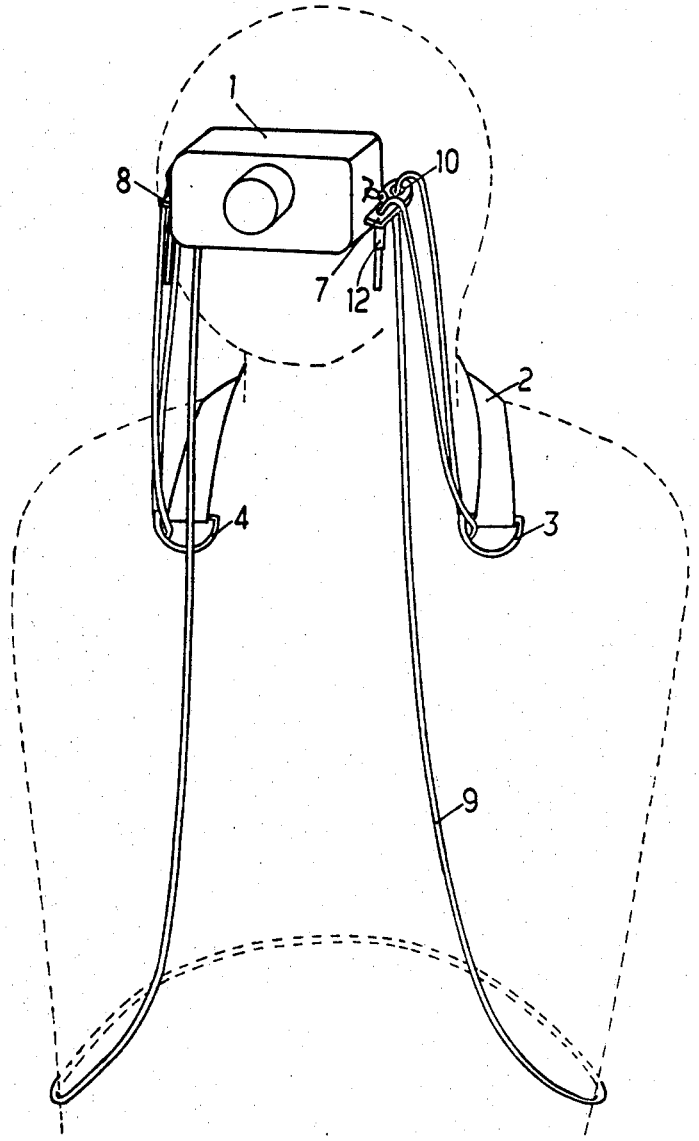
FIG. 2 is a frontal view showing the camera of the above embodiment in use.

In FIGS. 1 and 2, the portable instrument is shown as a camera for purposes of disclosure. The strap for portable use of the present invention comprises: a neck hang band 2; first and second hang rings 3 and 4 attached to the end of the neck hang band 2; first and second stopping means or brackets 7 and 8 which are connected to hangers 5 and 6, respectively, connected to the sides of the camera 1; and flexible string, cord or the like tethering means 9. One end of the string 9 is fixed to the first stopping means 7, and the string 9 is movably passed through the first hang ring 3 and back to a string-passing hole 10 of the first stopping means 7 to form a closed, slidable loop. The string 9 also passes through a string-passing hole 11 of the second stopping means 8 and the second hang ring 4, and after that is fixed to the second stopping means 8 thereby forming a second closed and slidable loop. In use, the neck band 2 is placed around a user's neck to suspend the camera in front, and a torso portion 9*a* of the string 9, which extends between the string-passing hole 10 of the first stopping means 7 and the string-passing hole 11 of the second stopping means 8 and connects the closed loop portions, is placed around the back of the user's torso.

As shown in FIG. 1, in use, the strap for portable use of the present invention prevents the camera 1 from a swinging motion by circling the torso portion 9*a* of the string 9 around the user's torso. Therefore, even if the user moves or bends, the camera 1 is prevented from a swinging motion which might cause the camera 1 to clash against something and do considerable damage to the camera 1.

When the user wants to use the camera 1, as shown in FIG. 2, the user can easily hold the camera 1 at his eye level by letting the string 9 slidably pass through the first and second hang rings 3 and 4, and the string-passing holes 10 and 11 of the first and second stopping means 7 and 8.

Figure 3:
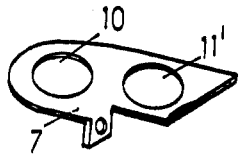
FIG. 3 is a perspective view showing the construction of the stopping means used in the above embodiment.
Figure 4:
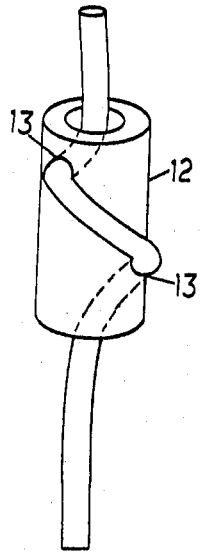
FIG. 4 is a perspective view showing the construction of the tubular string stopper used in the above embodiment.

In the preferred embodiment, as shown in FIGS. 3 and 4, each of the first and second stopping means 7 and 8 is provided with a small hole 11' for engaging with the string 9 in addition to the string-passing holes 10 and 11. The end of the string 9 is passed through two holes 13 of a tubular string stopper 12, the upper surface of which abuts the lower side of the first and second stopping means 7 and 8 on the periphery of the small hole 11' thereof and thereby prevents the string 9 from slipping out of the tubular string stopper 12, and also it becomes possible to adjust the length of the torso portion 9*a* of the string 9 in accordance with the body size of the user by adjusting the position of the tubular string stopper 12 relative to the string 9 so as to set the camera 1 at an appropriate position.

Figure 5:
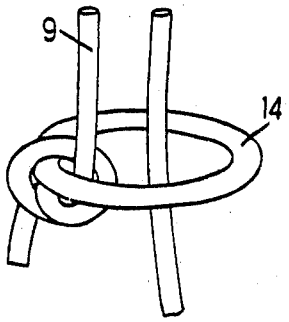
FIG. 5 is a perspective view showing another embodiment of the stopping means.

It should be easily understood that the present invention is not limited to the above embodiment. For example, in another embodiment shown in FIG. 5, it is possible to use a simple ring 14 as the first and second stopping means 7 and 8 and binding or otherwise tethering the end of the string 9 to the ring 14. It is also possible to employ any other connecting means as the first and second stopping means 7 and 8. And, also it is possible to employ an adjustable length band as a neck hang band 2, and to provide it with a ring-like configuration.

As mentioned above, since the strap for portable instrument of the present invention prevents the portable instrument from a swinging motion, the portable instrument is prevented from damage caused by its clashing against objects near to the user. This is one of the useful effects of the present invention. This present invention makes it possible to lift up the portable instrument such as a camera, binoculars, and the like smoothly to the user's eye level. More over, the present invention provides a novel hang strap for portable instrument at a low cost. This is also one of the advantages of the present invention.

It is believed that the present invention and many of its attendant advantages will be understood from the foregoing description, and it will be apparent that various changes may be made in the form, construction and arrangement of the parts without departing from the spirit and scope of the present invention as defined in the appended claims.

What is claimed is:

1. A hang strap for a portable instrument comprising: a neck hang band with first and second hang rings; first and second stopping means connected to the portable instrument; and a string; one end of said string being fixed relative to said first stopping means and the other end of said string being movably passed through said first hang ring and back through a string-passing hole of said first stopping means and thence through a string-passing hole of said second stopping means and said second hang ring, and after that being fixed relative to said second stopping means; and said string having a torso portion, which extends between said string-passing hole of said first stopping means and said string-passing hole of said second stopping means, and being circled around the user's torso in use.

2. A hang strap for portable instrument according to claim 1, wherein each of said first and second stopping means is provided with a small hole for receiving said string in addition to said string-passing hole.

3. A hang strap for portable instrument according to claim 2, wherein a pair of tubular stoppers are provided for abutment on the periphery of said small hole of said first and second stopping means, each end of said string being passed through two holes of each of said tubular stoppers.

4. A hang strap for portable instrument according to claim 1, wherein each of said first and second stopping means is formed by a simple ring.

5. A hang strap for a portable instrument comprising, in combination with a neck band adapted to hang around a user's neck and having depending ends, first and second stopping means connected to the instrument, and flexible unitary and non-elastic tethering means including at least one slidable loop portion and a torso portion; said tethering means being connected adjacent to one of its ends to said first stopping means and said loop portion of said tethering means extending from the first stopping means and being slidably engaged with one end of said neck band and with said first stopping means, and said torso portion being adapted to encircle the user's torso between said first and second stopping means to restrain the instrument from free swinging movement.

6. The hang strap according to claim 5, in which said tethering means includes a second loop portion extending from said second stopping means and being slidably connected to the other end of said neck band and to said second stopping means, and said loop portions being interconnected by said torso portion extending between said first and second stopping means.

* * * * *